US007644843B1

(12) United States Patent
Bush et al.

(10) Patent No.: US 7,644,843 B1
(45) Date of Patent: Jan. 12, 2010

(54) REVERSE TAPER DISPENSING ORIFICE SEAL

(75) Inventors: Randall G. Bush, Evansville, IN (US); Gary V. Montgomery, Evansville, IN (US); William J. Shankland, Evansville, IN (US)

(73) Assignee: Rexam Closures and Containers Inc., Evansville, IN (US)

( * ) Notice: Subject to any disclaimer, the term of this patent is extended or adjusted under 35 U.S.C. 154(b) by 321 days.

(21) Appl. No.: 11/610,727

(22) Filed: Dec. 14, 2006

(51) Int. Cl.
*B65D 47/00* (2006.01)

(52) U.S. Cl. ..... 222/546; 222/556; 220/836; 215/235

(58) Field of Classification Search ..... 222/456, 222/153.05, 153.06, 541.9, 554–557, 562–570, 222/575; 215/347, 237, 343–345, 235, 236; 220/386–389, 254.3, 254.4, 810, 833–841
See application file for complete search history.

(56) References Cited

U.S. PATENT DOCUMENTS

| | | | |
|---|---|---|---|
| 279,989 | A | 6/1883 | Steinhorst |
| 1,578,418 | A | 3/1926 | Gannon |
| 1,631,430 | A | 6/1927 | Schreiber |
| 2,103,111 | A | 12/1937 | Ekdahl |
| 2,143,860 | A | 1/1939 | Chamberlain |
| 2,204,176 | A | 6/1940 | Chamberlain |
| 2,212,367 | A | 8/1940 | Halsey |
| D136,098 | S | 8/1943 | Hartman, Sr. |
| 2,574,720 | A | 11/1951 | Trout et al. |
| 2,755,976 | A | 7/1956 | Markstein et al. |
| 2,851,203 | A | 9/1958 | Nowak |
| 3,002,660 | A | 10/1961 | Taylor |
| 3,133,310 | A | 5/1964 | Yorker et al. |
| 3,146,921 | A | 9/1964 | Brady |
| 3,160,327 | A | 12/1964 | Porcelli |
| D200,270 | S | 2/1965 | Watermann |
| 3,255,928 | A | 6/1966 | Foster |
| 3,285,479 | A | 11/1966 | Porter et al. |
| 3,322,308 | A | 5/1967 | Foster |
| 3,369,707 | A | 2/1968 | Porter et al. |
| 3,381,857 | A | 5/1968 | Francis |
| 3,549,060 | A | 12/1970 | Smylie |
| 3,651,992 | A | 3/1972 | Hazard |

(Continued)

FOREIGN PATENT DOCUMENTS

| | | |
|---|---|---|
| CA | 976113 | 10/1975 |

(Continued)

OTHER PUBLICATIONS

Product Offered For Sale Feb. 1999.

*Primary Examiner*—Lien T Ngo
(74) *Attorney, Agent, or Firm*—John F. Salazar; Chad D. Bruggeman; Middleton Reutlinger

(57) ABSTRACT

A dispensing system having a reverse taper dispensing orifice seal. The reverse tapered seal depends from a lid of a flip-top closure providing a sealing engagement with a dispensing spout of the flip-top closure body when in a closed position. As the dispensing spout may have a variety of shapes, the reverse tapered seal is shaped to conform to the irregularities of the contacted surfaces of the dispensing spout. The decreasing thickness of the reverse tapered seal decreases the complexity of the molding process as well as minimizing the weakening or breaking of the seal during removal from the mold cavity.

26 Claims, 8 Drawing Sheets

U.S. PATENT DOCUMENTS 3,819,194 A 6/1974 Grevich et al.
3,831,824 A 8/1974 Coppersmith
4,010,875 A 3/1977 Babiol
4,022,352 A 5/1977 Pehr
RE29,793 E 10/1978 Pehr
4,220,248 A 9/1980 Wilson et al.
D280,606 S 9/1985 Kennedy et al.
4,625,898 A 12/1986 Hazard
4,638,916 A 1/1987 Beck et al.
D291,411 S 8/1987 Crawford
4,723,693 A 2/1988 DeCoster
4,735,334 A 4/1988 Abbott
4,778,071 A 10/1988 Fillmore
4,795,043 A 1/1989 Odet et al.
4,795,044 A 1/1989 Beck
4,801,054 A * 1/1989 Nycz ..... 222/545
4,838,441 A 6/1989 Chernack
4,881,668 A 11/1989 Kitterman et al.
4,899,902 A 2/1990 DeMars
4,934,590 A 6/1990 Robichaud et al.
4,964,539 A 10/1990 Mueller
5,007,555 A 4/1991 Beck
5,044,530 A 9/1991 Stull
5,065,912 A 11/1991 Rosenthal
5,094,361 A 3/1992 Dubach
5,143,234 A 9/1992 Lohrman et al.
D331,877 S 12/1992 Robichaud et al.
5,289,950 A 3/1994 Gentile
5,318,203 A 6/1994 Iaia et al.
5,320,235 A 6/1994 Joyce
5,330,083 A 7/1994 Bartimes et al.
5,353,970 A 10/1994 Stull et al.
5,370,284 A 12/1994 Dirksing
5,381,935 A 1/1995 Mock
D355,121 S 2/1995 Kohl
D356,026 S 3/1995 Iaia et al.
5,492,253 A 2/1996 Proshan
5,499,736 A 3/1996 Kohl
5,547,091 A * 8/1996 Neveras et al. ..... 215/237
5,558,239 A 9/1996 Dubach
5,577,625 A 11/1996 Baird et al.
5,620,107 A 4/1997 Takeuchi
5,655,684 A 8/1997 Krall
5,762,216 A 6/1998 Takeuchi
5,779,110 A 7/1998 Brown et al.
5,782,388 A 7/1998 De Nervo
5,853,109 A 12/1998 Elliott
5,899,361 A 5/1999 Durliat et al.
5,938,087 A 8/1999 Randall
5,954,231 A 9/1999 Durliat et al.
5,967,384 A * 10/1999 Mengeu et al. ..... 222/517
D424,440 S 5/2000 Wilkinson et al.
6,056,142 A 5/2000 Elliott
6,170,719 B1 1/2001 Wilkinson et al.
D440,494 S 4/2001 Sagel et al.
6,257,431 B1 7/2001 Baudin
6,305,563 B1 10/2001 Elliott
6,321,923 B1 * 11/2001 Wood ..... 215/235
6,325,226 B1 * 12/2001 Krautkramer ..... 215/252
6,343,725 B1 2/2002 Lohrman
6,394,323 B2 5/2002 McClean et al.
6,419,101 B1 7/2002 Hessel et al.
6,431,416 B1 8/2002 Lohrman
6,460,729 B2 10/2002 Beecroft
6,502,722 B1 1/2003 Shimizu et al.
6,510,971 B1 1/2003 Martin
6,543,207 B2 4/2003 Mainquist et al.
6,550,646 B1 4/2003 Takahara et al.
6,622,895 B2 9/2003 McClean et al.
6,688,501 B2 2/2004 DeGroot et al.
6,722,536 B2 4/2004 Bremner et al.
6,779,672 B2 * 8/2004 Kano et al. ..... 215/344
6,821,239 B2 * 11/2004 Hierzer et al. ..... 493/344
6,830,721 B2 12/2004 Martin
6,935,543 B2 8/2005 DeGroot et al.
D509,429 S 9/2005 Hierzer et al.
6,948,643 B1 9/2005 Lohrman
6,971,547 B2 12/2005 Enlert et al.
7,021,477 B2 4/2006 Wolfe
7,040,499 B1 5/2006 Reif
7,048,158 B2 * 5/2006 Hierzer ..... 222/546
7,051,905 B2 5/2006 Hierzer
7,128,227 B2 * 10/2006 Skillin et al. ..... 215/235
7,255,250 B2 * 8/2007 Pugne ..... 222/556
2002/0179644 A1 12/2002 Evans et al.
2005/0279781 A1 12/2005 Pugne
2006/0006129 A1 1/2006 Baudin
2006/0011667 A1 1/2006 Skillin et al.
2006/0186077 A1 * 8/2006 Robinson ..... 215/237

FOREIGN PATENT DOCUMENTS

FR 2790454 3/1999
GB 2224309 A 10/1989
JP 02-139357 A 5/1990
JP 10-167302 A 6/1998
WO 01/96198 A1 12/2001

* cited by examiner

REVERSE TAPER DISPENSING ORIFICE SEAL

TECHNICAL FIELD

The present invention relates to a dispensing orifice seal in particularly to a dispensing orifice seal with a reverse taper.

DETAILED DESCRIPTION

Figure 1:
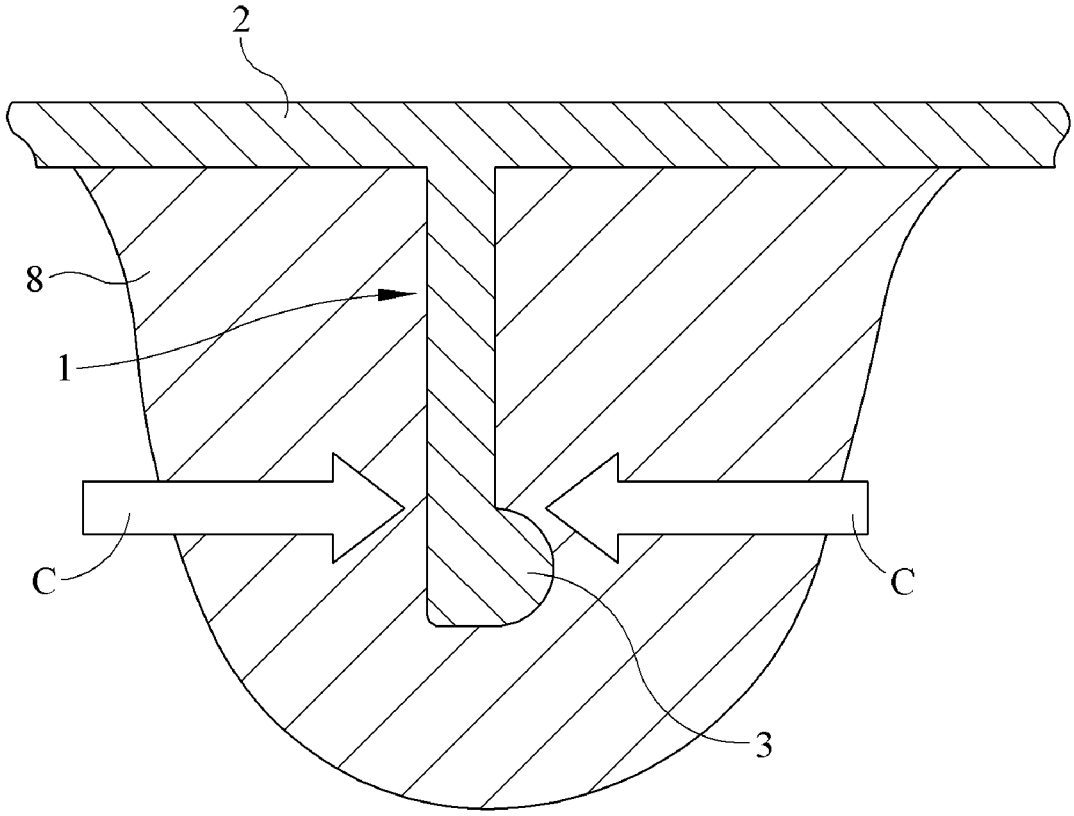
PRIOR ART FIG. 1
FIG. 1 is an enlarged partial sectional view of a dispensing orifice seal of the prior art, shown, within the mold cavity in which it has been formed.

A dispensing system 10 according to one embodiment of the present invention depicted in the drawings has a flip-top closure 20 structured to provide an adequate sealing engagement of the dispensing spout 44*a* of the flip-top closure body 40. The orifice 41 of spout 44*a* is sealed by a reverse taper sleeve or seal 32 engaging the spout.

Figure 2:
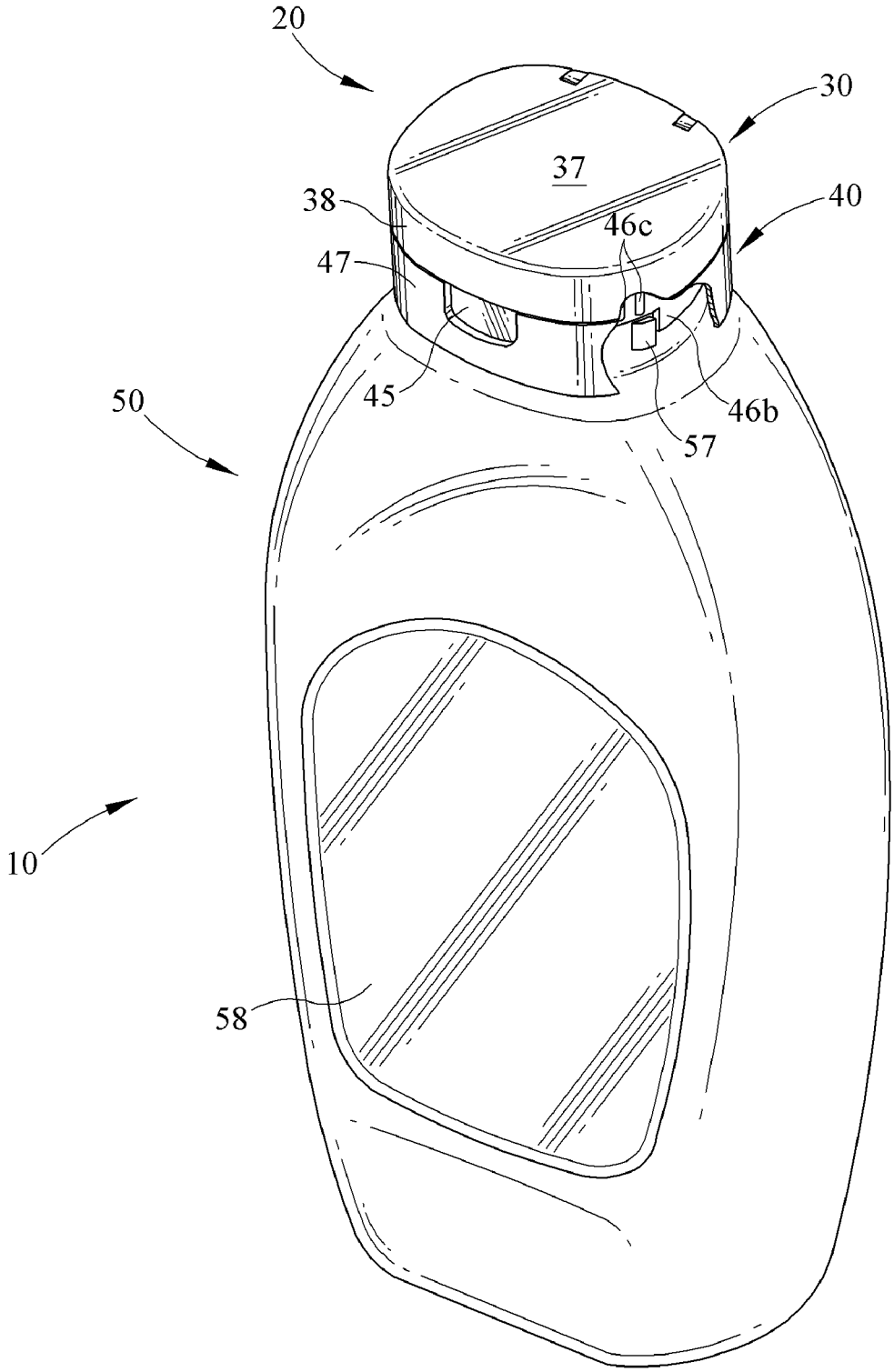
FIG. 2 is a perspective view of a flip-top dispensing system embodiment in a closed configuration with the closure partially broken away.
Figure 4:
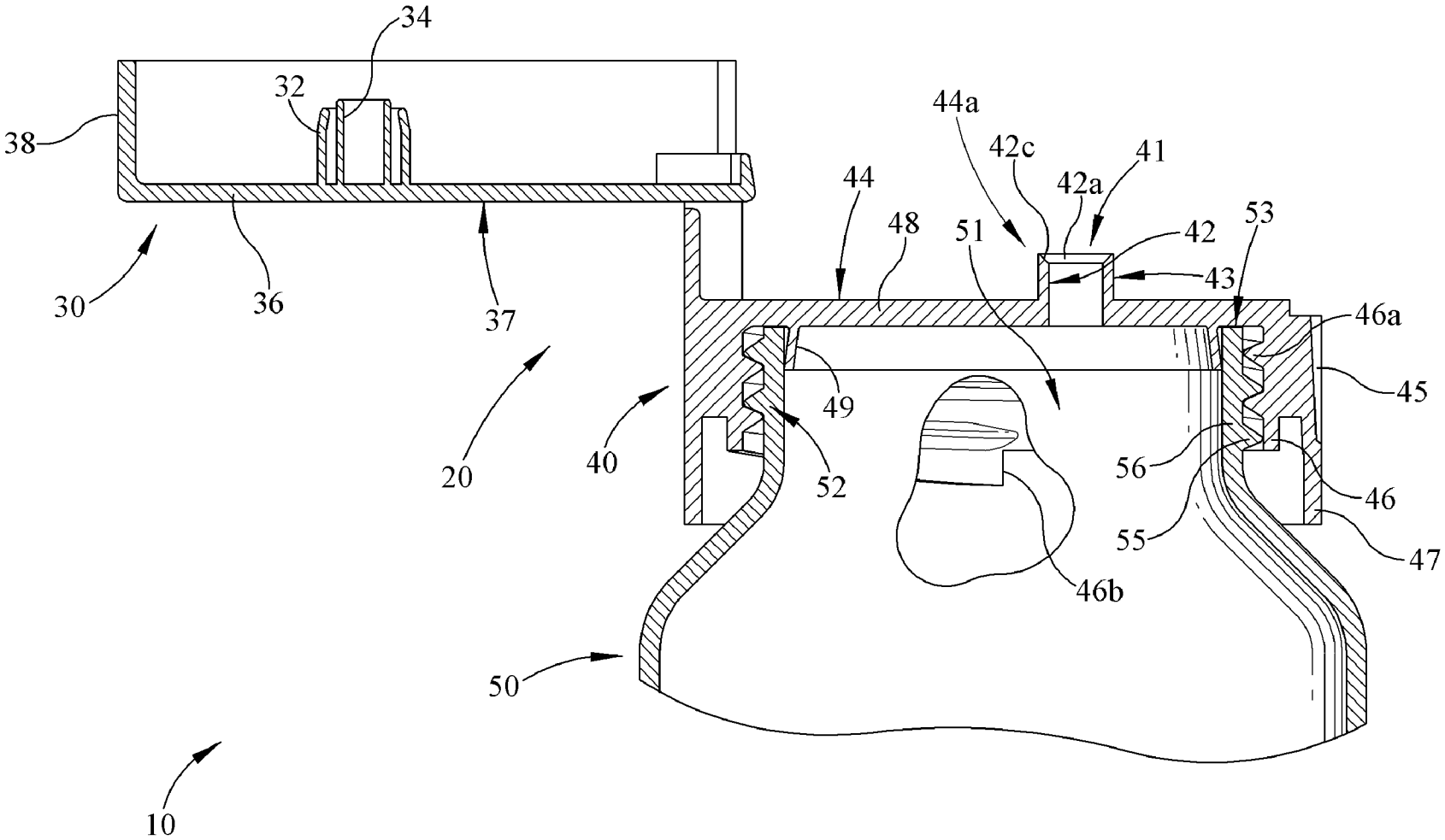
FIG. 4 is a partial sectional view of the flip-top dispensing system of FIG. 3 taken along line 4-4 with the container finish partially broken away.

As shown in FIGS. 2 and 4, the flip-top closure 20 engages a container finish 52 of a container 50 having an opening 51 therein. The container's may be designed to hold a variety of products as for example but not limited to viscous materials that can either be perishable or non-perishable. Container finish 52 as shown may include, but is not limited to, a helically threaded end. Flip-top closure 20 may engage container finish 52 by a variety of removable and non-removable means known in the art, not limited to dual snap-fit engagements or mating bead and groove engagement. Container 50 is of unitary construction and may be made of any of numerous materials commonly known in the art depending on specific product and environmental conditions. Some common examples of materials include but are not limited to polyethylene, polypropylene, and polyethylene terephthalate. Container 50 may generally have an elongated cylindrical shape, but is not limited to such and may be of any shape that best contains the product or has the greatest aesthetic appeal. Container 50 has a shoulder narrowing to a container neck finish 52 comprising a neck 56 that is of sufficient length to accommodate an external thread 55 for threaded engagement of flip-top closure 20 with the container. At the top of neck 56 is opening 51 permitting access to the contents of container 50. At least one lug stop 57 (FIG. 2) is provided at the base of the neck 56, adjacent the shoulder. Alternatively two such lug stops may be provided, on opposing sides of neck 56. Lug stop 57 may act as a barrier to prevent flip-top closure 20 from being seated too far down upon container neck finish 52; it may also be used to align or orient the closure with respect to a label 58 or a surface of container 50, or orient the closure relative to the container's shape. Although container 50 is shown in detail in FIGS. 2 and 4, it is merely representative of containers in general, and it is to be understood that there are a variety of containers of different shapes and sizes that may be used with the closure embodiments herein.

Figure 3:
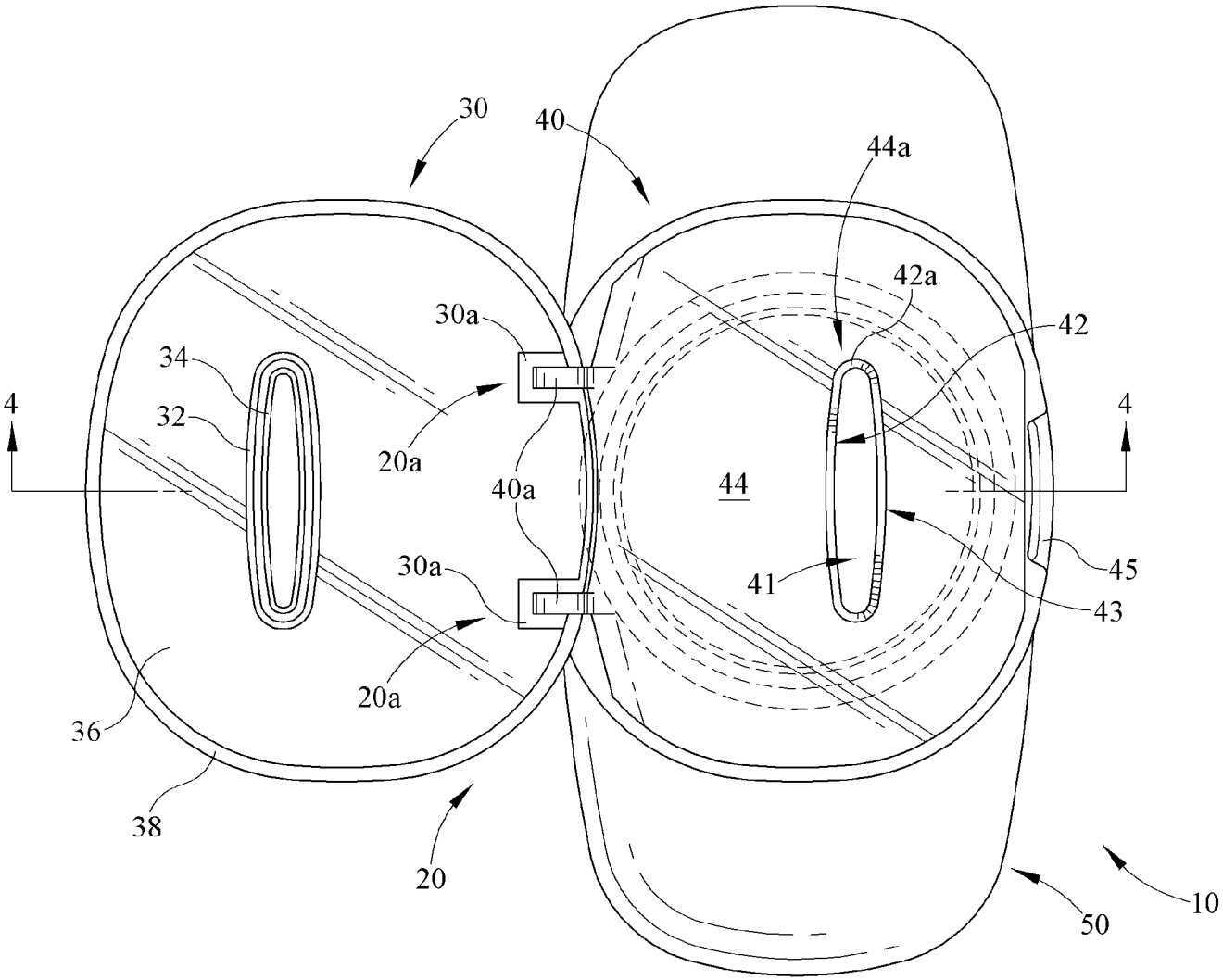
FIG. 3 is a top view of the embodiment of FIG. 2 in an open configuration.
Figure 5:
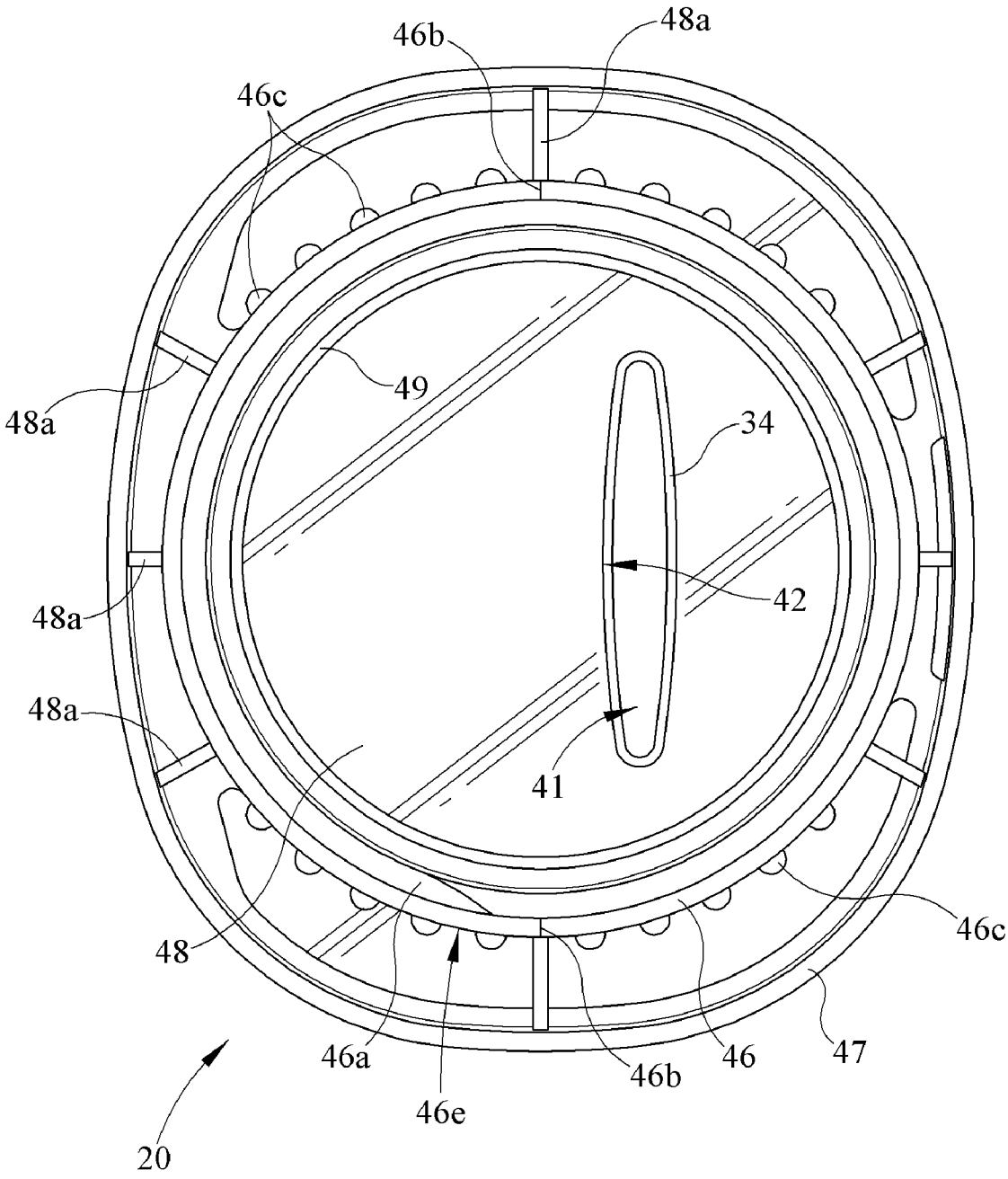
FIG. 5 is a bottom view of the flip-top closure of FIG. 2 in a closed configuration.

As illustrated in FIGS. 2, 3, and 4, flip-top closure 20 includes a closure base or body 40 and a lid 30. Lid 30 is connected to body 40 by hinge 20*a* which accommodates movement of lid 30 from a closed position (FIG. 2) to an open position (FIGS. 3 and 4) while maintaining a secure attachment of lid 30 to closure body 40. As shown in FIG. 3, hinge 20*a* can be used to join a two piece molded flip-top closure. For example, hinge 20*a* may comprise a pair of arms 40*a* integrally molded with body 40. Arms 40*a* can then connect to the separately molded lid 30 at slotted abutments 30*a* which are integrally molded with lid 30. Alternately other types of hinge means known in the art, including but not limited to a living hinge type, may be used to connect lid 30 and body 40. As shown in FIGS. 4 and 5, closure body 40 may comprise an inner shell 46 and an outer shell 47, both depending from a top wall 48. Inner shell 46 is adapted to removably or fixedly receive the upper end or neck 56 of container 50. The interior surface of inner shell 46 includes suitable connecting means, such as a conventional thread 46*a* adapted for threaded engagement with a mating container thread 55 as illustrated in FIG. 4. As shown in FIGS. 2 and 4, inner shell 46 may also comprise at least one drop lug 46*b* adapted to engage lug stop 57 on container neck 56 at the appropriate position of rotation of closure 20 to provide the desired alignment of closure 20 with container 50. Specifically when flip-top closure 20 is rotated clockwise onto the threaded container finish 52 of container 50, drop lug 46*b* depending from inner shell 46 is threaded down to the point where drop lug 46*b* engages with the corresponding and interfering lug stop 57. Upon being seated as desired on container finish 52, flip-top closure 20 will be properly orientated with respect to container 50 because of the corresponding drop lug and lug stop engagement. The position of engagement of the drop lug and lug stop may be varied to insure that closure body orifice 41 will be oriented properly relative to container 50. Outer shell 47 may be designed with a variety of shapes and sizes, including being the same as inner shell 46. However as shown in the drawings, the outer shell may also be shaped to conform to the shape of container 50, which in the embodiment illustrated is substantially oval. Also as shown in FIG. 5, a plurality of webs or gussets 48*a* of an appropriate size and shape may interconnect inner shell 46 to outer shell 47 adjacent to top wall 48 of closure body 40. Such interconnection by webs 48*a* increases the strength and rigidity of closure body 40.

Additionally, the position of engagement of drop lug 46*b* with lug stop 57 may in some cases limit the axial distance traveled by flip-top closure 20 along container finish 52, so that a clearance will be left between top wall 48 and container lip 53, possibly allowing leakage from inside container 50. To prevent such leakage, a plug seal 49 (FIG. 5) or a variety of different radial seals can be formed to depend from top wall 48 of closure body 40 in position to engage the interior of container neck 56 when closure 20 is engaged with container finish 52. In other words, when closure 20 is seated upon container finish 52 to the point where drop lug 46*b* and stop lug 57 engage (FIG. 2), possibly for orientating container 20 to the front of the container, plug seal 49 can engage and seal the interior of container neck opening 51.

As shown in FIGS. 2, 3, and 4, the exterior of outer shell 47 of closure body 40 includes a thumb recess 45. Positioned above thumb recess 45, the top of closure body 40 defines a peripheral deck or top surface 44. Extending upwardly from top surface 44 of closure body 40 is an ovalized spout 44*a*. Spout 44*a* defines a closure body orifice 41 through top wall 48 creating a dispensing channel from within the container 50. The lateral walls of spout 44*a* have an inner surface 42 and an opposing outside surface 43 and a distal rim 42*a* therebetween. When lid 30 is in the open configuration (FIGS. 3 and 4), orifice 41, defined by spout 44*a*, permits contents to travel out of the container opening 51. Orifice 41 and spout 44*a* are shown in FIG. 3 to be elongated and ovalized in shape, however they may take any number of sizes and shapes including circular, as will be recognized by one skilled in the art. The elongated spout 44*a* may have non-parallel lateral walls as depicted in FIG. 3 or alternatively have other configurations. As illustrated in FIG. 4, distal rim 42*a* between inner surface 42 and outer surface 43 of spout 44*a* may have chamfered edges 42*c*, or alternatively have a rounded or radial edge, to facilitate the lead-in of the congruent lid 30 when the lid moves into the closed configuration. Inner and outer surface 42 and 43 form a dispensing channel through the upstanding lateral walls of spout 44*a*. These spout 44*a* walls extend above the lid top surface 44 about three millimeters and may be vertical or slightly angled. They may also have a thickness of about one millimeter. Stiffness in the spout 44*a* walls may be desirable as the tapered pressure of the taper seal 32 may alter the desired configuration of the spout.

Figure 6:
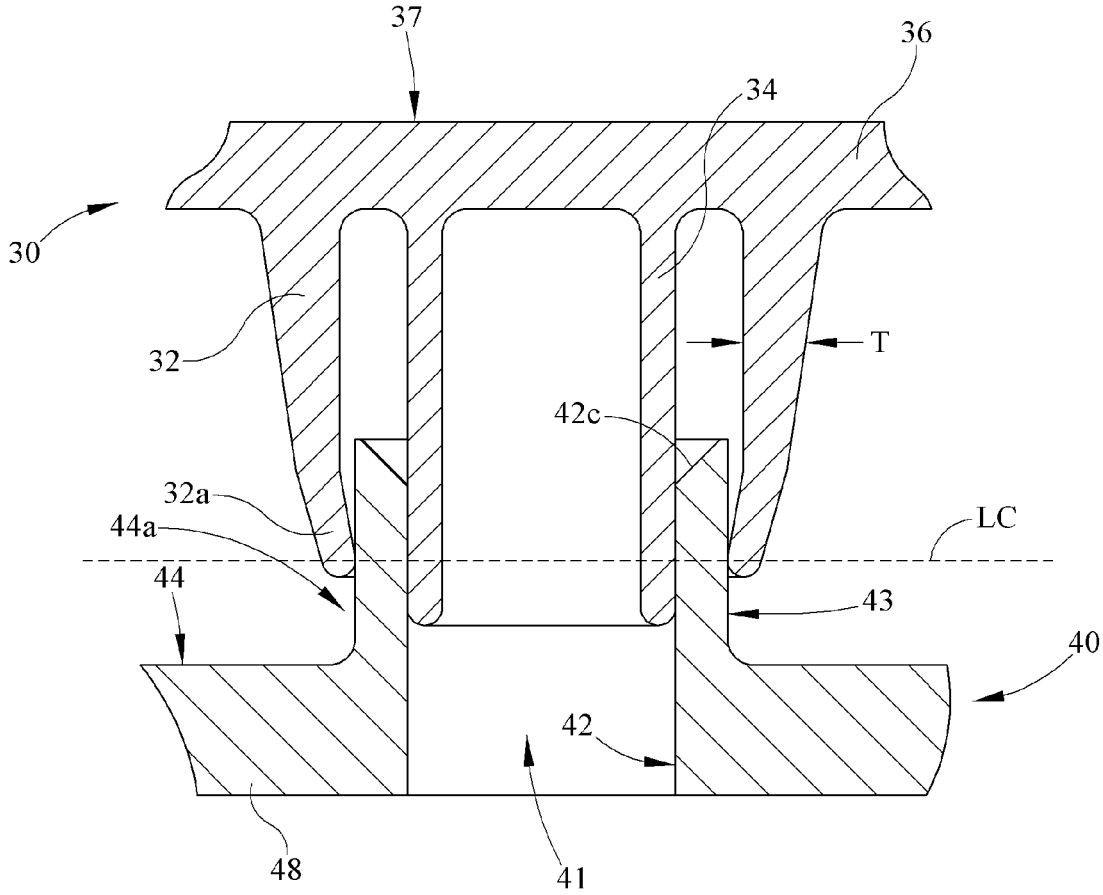
FIG. 6 is an enlarged sectional view of the reverse taper dispensing orifice seal of the embodiment of FIG. 4 in a closed configuration.

In the closed configuration (FIGS. 2 and 6), lid 30 provides the means for sealing orifice 41 of closure body 40. Lid 30 has a central portion or deck 36 and a downwardly depending, peripheral skirt 38. At the front of lid skirt 38 in registry above thumb recess 45, there may be an outwardly projecting thumb or finger lid lift (not shown). The user may initially lift lid by applying an upward force with a finger or thumb to a portion of lid skirt 38 accessible because of the opening created by thumb recess 45. Lid 30 may be rotated to a fully opened position as shown in FIGS. 3 and 4 to open the entrance to orifice 41. Also depending from the bottom surface of lid deck 36 is a sleeve or seal 32, alone or in combination with a plug 34. Sleeve 32 depends from lid deck 36 and engages the periphery or outer surface 43 of spout 44*a* as shown in FIG. 6, or alternatively sleeve 32 may engage inner surface 42 of spout 44*a*. Sleeve 32 has a reverse taper, as more fully described below, so that it can engage spout 44*a* and adequately seal orifice 41 of closure body 40. In opposing relation to sleeve 32 during engagement of spout 44*a*, plug 34 depends from lid deck 36 in a co-axial relationship with sleeve 32, and in one embodiment shown in FIG. 6, engages the opposite surface of the spout than that which the sleeve contacts. Alternatively but not shown in the drawings, if sleeve 32 is in sealing engagement with inner surface 42 of spout 44*a*, then plug 34 will be engaging outer surface 43 of spout 44*a*. Sleeve 32 and plug 34 may also each be provided with a chamfered free end or have a radiused tip to facilitate entry when either is used to engage the inner surface 42 of spout 44*a*. Both sleeve 32 and/or plug 34 will be provided with a substantially congruent shape to that of the dispensing spout 44*a*.

As shown in FIG. 6, the reverse taper of sleeve 32 may be provided by tapering or decreasing the thickness T of sleeve 32 from deck 36 to distal end 32*a* of the sleeve. Sleeve 32 may be provided in various reverse tapered shapes in cross section, for example the cross section of the embodiment depicted in FIGS. 4 and 6 is dog-leg shaped. The dog-leg shaped sleeve 32 decreases in thickness to distal end 32*a*, where the sleeve makes contact with and forms a seal with outer surface 43 of spout 44*a*. The distal end of this embodiment of sleeve 32 approaches the spout's outer surface 43 at an angle. Alternatively, the angle of the distal end of sleeve 32 may be reversed if designed to seal with inner surface 42 of spout 44*a* (not shown). The angled distal end of sleeve 32 provides a biased engagement with the surface of spout 44*a* and forms a line contact seal, generally shown as line LC, which is continuous around the spout. A line contact seal LC is capable of withstanding higher pressures during the sealing engagement. Another benefit of sleeve 32 having a reverse taper is that it provides increased flexibility near the point of engagement with the surface of spout 44*a*, allowing the sleeve to conform to irregularities on the outer or inner surfaces 42 or 43, to ensure an adequate sealing engagement.

Figure 7:
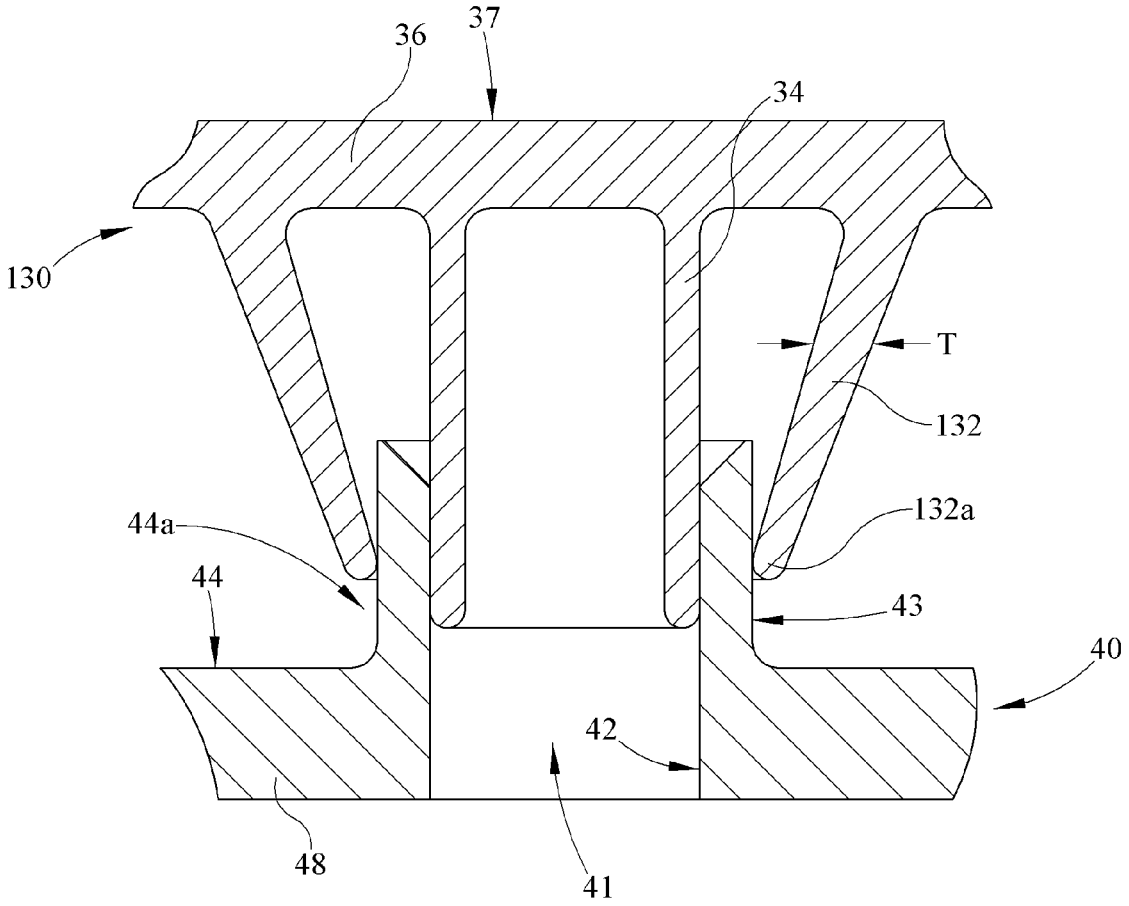
FIG. 7 is an enlarged sectional view of another embodiment of the reverse taper dispensing orifice seal in a closed configuration.

Another embodiment of the reverse taper sleeve or seal is shown in FIG. 7. In this embodiment, the entire tapered portion of sleeve 132 is angled from deck 36 to distal end 132*a* to provide the desired biased line contact seal with a surface of spout 44*a*. Similarly, with the embodiment of FIG. 6, the angle of the entire tapered portion of sleeve 132 with deck 36 may be reversed if it is desired to have sleeve 132 contact the inner surface 42 of spout 44*a*. As will be recognized by those skilled in the art, a variety of different sizes, shapes, and various depending angles of sleeves incorporating a tapering thickness T may be constructed for various applications.

As will be recognized by those skilled in the art, flip-top closure 20, either closure body 40 and/or lid 30, may be provided in any number of different shapes and sizes and still function to have a reverse tapered dispensing orifice seal. Flip-top closure 20 is shown in FIGS. 2, 3, and 5 to have an outside perimeter substantially ovalized and subsequently placed upon container finish 52 of a congruently shaped container 50. The oval shaped flip-top closure 20 can be seated in congruent shape relationship with container 50 by drop lug 46*b* and lug stop 57 while threadably securing the closure to the container. Closure lid 30 also has lid deck 36 with a substantially flat top surface 37 permitting container 50 to be oriented on either end of dispensing system 10, thus container 50 and its contents can balance upon the flat top surface 37 of flip-top closure 20.

Sleeve 32 or 132 can work individually or in combination with plug 34 to create a sealing engagement with spout 44*a*. While lid 30 is in its fully closed configuration, sleeve 32 engages spout 44*a* to form the seal enclosing orifice 41. When a plug 34 is included in the sealing engagement, the plug may be longer than sleeve 32. Spout 44*a* is disposed between plug 34 and sleeve 32 such that the exterior surface of plug 34 contacts inner surface 42 of spout 44*a*. In doing so, plug 34 urges outer surface 43 of spout 44*a* outwardly against sleeve 32 to enhance the sealing engagement between the contacting surfaces. It may also be desirable to provide that the engagement between sleeve 32 and plug 34 be sized to tightly receive spout 44*a* without clearance or with a slight interference fit.

Another benefit of the use of a reverse taper on sleeve or seal 32 is that dispensing system 10 may be utilized without the liner often required in such systems. For example, various types of liners have been used in similar prior art systems including re-seal liners positioned to engage container lip 53, the use of malleable seal materials positioned along the inner surface of top wall 48, foil seals, or other seals known to those skilled in the art. In contrast, the plug 34 and sleeve 32 of the embodiments herein can serve to seal in the contents of container 50 without need for such liners. In fact a flip-top closure 20 with reverse taper sleeve 32 and plug 34 as shown, may serve to seal a linerless container from the time the contents are received into the container and for the duration of the useful life of the container. Alternatively, container 50 may comprise a liner and still utilize the embodiments of the present invention.

Various seal configurations have been proposed in the art for sealing. The seal 1 shown in FIG. 1 is typical of the prior art. Seal 1 depends from a top wall 2 of the lid of a closure and has a bead 3 which engages the outer periphery of the outer surface of a spout when the closure is in a closed configuration. There are several disadvantages associated with the seal 1 of FIG. 1. These existing seals have a tendency to weaken or break when they are removed from the mold cavity 8 in which they are formed. As shown in FIG. 1, bead 3 of seal 1 will be compressed when removed from mold cavity 8 as shown by the arrows C as the larger amount of material comprising bead 3 is forced to pass through a narrower ascending passageway in the mold. The compression C caused by this bottleneck of material in the mold may lead to the weakening and/or breaking of the seal. Using a mold designed with a plurality of mold core elements may eliminate the compression of seal 1 by allowing the sequential removal of individual core elements during the molding process. However, the use of multiple core elements increases the cost of the mold and the complexity of the molding process. Another disadvantage of the prior art bead seal 1 is that it typically still requires the use of an additional seal in the container as discussed above to preserve the potentially perishable contents of the container during storage and shipment.

Figure 8:
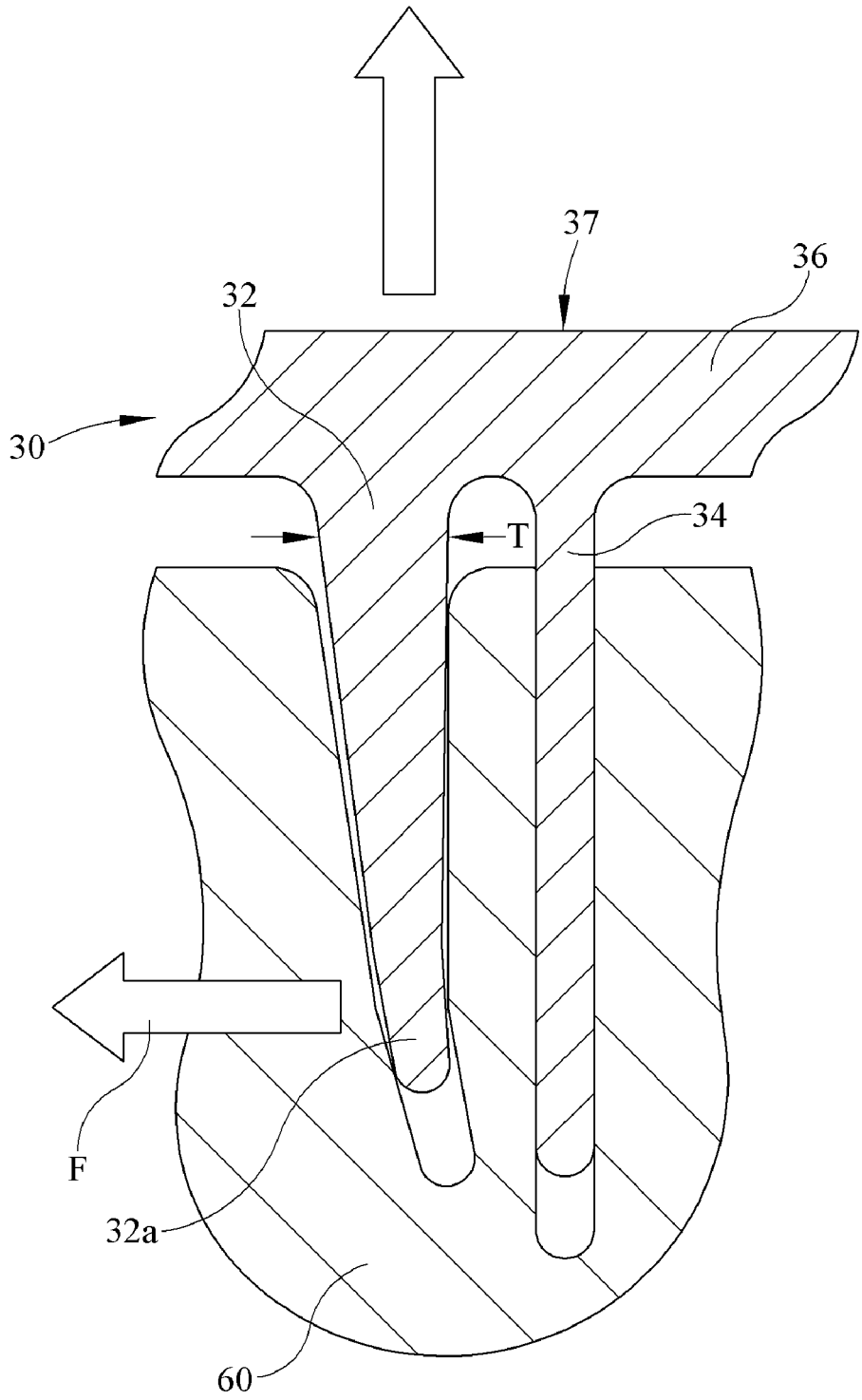
FIG. 8 is an enlarged sectional view illustrating the reverse taper dispensing orifice seal embodiment of FIG. 6 partially removed from the mold cavity in which it has been formed.

The reverse tapered seal of the embodiments herein minimizes the need for complex molds and molding processes yet maintains the integrity of the sleeve in the molding process. As previously discussed, the reverse taper sleeve 32 tapers by decreasing thickness T from deck 36 to distal end 32*a*. As shown in FIG. 8, this decreasing thickness T allows for sleeve 32 to be readily removable from a mold cavity 60 by means of a flexing mechanism F instead of being compressed to pass through a bottleneck in mold cavity 8 as discussed for the prior art seal depicted in FIG. 1. Since the reverse tapered sleeve 32 can be removed from mold cavity 60 by flexing, which puts much less stress on the seal material than the compression required by prior art designs, there is far less chance of weakening or breaking the seal material. Sleeve 32 can be removed from mold cavity 60 merely by flexing because the tapered profile allows it to be withdrawn with minimal resistance from the similarly tapered cavity. A single element mold cavity can be used in molding the reverse tapered seal rather than the plurality of mold core elements previously needed, decreasing the cost of the mold and the complexity of the molding process.

The molding process for the embodiments herein may also include the use of a plurality of knock-out pins (not shown) in the mold cavity to assist in the removal of flip-top lid 30. A plurality of vertical ribs 46*c* extend along an exterior surface 46*e* of inner shell 46 (FIG. 5) allow for the inner core element (not shown) of the mold cavity to be threaded out of the molded closure body 40. Ribs 46*c* contact the outer core element (not shown) of the mold cavity preventing rotation of closure body 40 while the inner core element is threadably removed.

It is understood that while certain embodiments of the invention have been illustrated and described, it is not limited thereto except insofar as such limitations are included in the following claims and allowable functional equivalents thereof.

We claim:

1. A flip-top closure with a reverse taper dispensing orifice seal comprising:

a closure body having a lid hingedly connected thereto;

said closure body having a top wall, said top wall having a top surface with a raised elongated spout projecting therefrom, said raised elongated spout having an opposed ovalized outer surface and an opposed ovalized inner surface defining an elongated orifice through said top wall;

said outer surface of said spout is substantially vertical;

said raised elongated spout including a chamfered edge on said inner surface of said spout;

said lid having a depending seal and a depending plug, said depending seal positioned to engage said outer surface of said spout when said lid is closed upon said closure body, said seal having a first end adjacent said lid and a distal end opposite therefrom;

said distal end of said seal having an inner surface and an outer surface, each of said inner surface and said outer surface of said distal end angularly positioned at an acute angle relative to the vertical axis of said orifice through said top wall, wherein said outer surface of said distal end is smaller in diameter than an outer surface of said first end of said seal and said inner surface of said distal end is smaller in diameter than an inner surface of said first end of said seal;

said acutely angled distal end tapering from a first thickness to a second thickness in a direction away from said first end of said seal, wherein said first thickness is larger than said second thickness;

said acutely angled distal end of said seal creating a line contact seal about the periphery of said substantially vertical outer surface of said raised elongated spout;

said plug having a first length and said seal having a second length wherein said first length is greater than said second length; and said plug engaging said inner surface of said closure raised elongated spout and urging said outer surface of said raised elongated spout outwardly against said seal distal end enhancing said line contact seal about the periphery of said raised elongated spout when said lid is closed upon said closure body.

2. The flip-top closure as in claim 1 wherein said closure body includes an outer shell and an inner shell depending from said top wall of said closure body and said outer shell and said inner shell being interconnected by a plurality of gussets.

3. The flip-top closure as in claim 2 wherein said inner shell includes at least one depending drop lug.

4. The flip-top closure as in claim 2 wherein said raised elongated spout having a pair of elongated lateral walls that are non-parallel.

5. The flip-top closure as in claim 1 wherein said top wall of said closure body includes a depending plug seal engaging an interior surface of a container neck opening.

6. The flip-top closure as in claim 1 wherein the entire said second length of said seal depends at said acute angle from said lid.

7. The flip-top closure as in claim 1 wherein said closure body and said lid are oval in shape.

8. The flip-top closure as in claim 1 wherein said lid has a flat top surface.

9. The flip-top closure as in claim 1 further comprising a front lift point.

10. A flip-top closure with a reverse taper dispensing orifice seal comprising:

a flip-top closure body having a top wall, said top wall having a top surface with a raised elongated spout projecting therefrom, said raised elongated spout having an opposed ovalized outer surface and an opposed ovalized inner surface defining an orifice through said top wall, said outer surface of said spout is substantially vertical;

said top wall including a depending inner shell and an outer shell, said inner shell adapted to engage the neck of a container and said inner shell including at least one depending drop lug adapted to engage the lug stop integrally formed on the neck of the container and said top wall having a depending plug seal adapted to engage the opening of the container neck;

said closure body having a flip-top lid hingedly attached thereto;

said lid having a depending sleeve and a depending plug, said depending sleeve positioned to engage said outer surface of said raise elongated spout when said lid is closed upon said closure body, said sleeve having a first end adjacent said flip-top lid and a distal end opposite therefrom;

said distal end of said sleeve having an inner surface and an outer surface, each of said inner surface and said outer surface of said distal end angularly positioned at an acute angle relative to the vertical axis of said orifice through said top wall, wherein said outer surface of said distal end is smaller in diameter than an outer surface of said first end of said sleeve and said inner surface of said distal end is smaller in diameter than an inner surface of said first end of said sleeve;

said acutely angled distal end tapering from a first thickness to a second thickness in a direction away from said first end of said sleeve, wherein said first thickness is larger than said second thickness;

said acutely angled distal end of said seal creating a line contact seal about the periphery of said substantially vertical outer surface of said raised elongated spout;

said plug having a first length and said sleeve having a second length, wherein said first length is greater than said second length, said plug engaging said inner surface of said raised elongated spout and urges said outer surface of said raised elongated spout outwardly against said sleeve distal end enhancing said line contact seal about the periphery of said closure raised elongated spout when said lid is closed upon said closure body.

11. The flip-top closure as in claim 10 wherein said outer shell and said inner shell being interconnected by a plurality of gussets.

12. The flip-top closure as in claim 10 wherein an exterior surface of said inner shell has a plurality of ribs.

13. The flip-top closure as in claim 10 wherein the entire said second length of said sleeve depends at said acute angle from said lid.

14. The flip-top closure as in claim 10 wherein said raised elongated spout includes a chamfer.

15. The flip-top closure as in claim 10 wherein said closure body and said lid are oval in shape and said lid has a flat top surface.

16. The flip-top closure as in claim 10 wherein said closure lid includes a front lift point.

17. A dispensing system with a reverse taper dispensing orifice seal comprising:

a container having a neck with an opening which is surrounded by a lip;

a flip-top closure body engageable with said neck to overlie said opening;

said closure body having a top wall, said top wall having a top surface with a raised elongated spout projecting therefrom, wherein said raised elongated spout having a pair of elongated lateral walls that are non-parallel, said raised elongated spout having an opposed ovalized outer surface and an opposed ovalized inner surface defining an orifice through said top wall;

said outer surface of said raised elongated spout is substantially vertical;

said closure body having a flip-top lid hingedly attached thereto;

said lid having a depending seal and a depending plug, said depending seal positioned to engage said outer surface of said spout when said lid is closed upon said closure body, said seal having a first end adjacent said lid and a distal end opposite therefrom, said distal end having an outer surface and an inner surface, wherein said outer surface and said inner surface of said distal end is frustoconical in shape, thereby said outer surface and said inner surface of said seal distal end is smaller in diameter than said first end of said seal;

said frustoconical distal end tapering from a first thickness to a second thickness in a direction away from said first end of said seal wherein said first thickness is larger than said second thickness;

said seal distal end creating a line contact seal about the periphery of said substantially vertical outer surface of said closure raised elongated spout thereby completely sealing said orifice when said flip-top lid is in a closed position relative to said closure body;

said plug having a first length and said seal having a second length, wherein said first length is greater than said second length; and said plug engaging said inner surface of said closure raised elongated spout when said flip-top lid is in said closed position relative to said closure body.

18. The dispensing system as in claim 17 wherein said closure body includes an outer shell and an inner shell depending from said top wall of said closure body, wherein said inner shell engages said neck and said outer shell and said inner shell being interconnected by a plurality of gussets.

19. The flip-top closure as in claim 18 wherein an exterior surface of said inner shell has a plurality of ribs.

20. The dispensing system as in claim 18 wherein said inner shell includes at least one depending drop lug, wherein said at least one drop lug engages at least one lug stop integrally formed on said neck.

21. The dispensing system as in claim 20 wherein said at least one drop lug engages said at least one lug stop whereby said orifice aligns to a predefined surface of said container.

22. The dispensing system as in claim 17 wherein said closure body includes a depending plug seal engaging said opening of said neck.

23. The dispensing system as in claim 17 wherein said raised elongated spout includes a chamfer.

24. The dispensing system as in claim 17 wherein said container lip includes a liner sealingly disposed over said opening.

25. The dispensing system as in claim 17 wherein said closure body and said lid are oval in shape and said lid has a flat top surface.

26. The dispensing system as in claim 17 further comprising a front lift point.

* * * * *

UNITED STATES PATENT AND TRADEMARK OFFICE

CERTIFICATE OF CORRECTION

PATENT NO. : 7,644,843 B1
APPLICATION NO. : 11/610727
DATED : January 12, 2010
INVENTOR(S) : Bush et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 350 days.

Signed and Sealed this

Twenty-first Day of December, 2010

David J. Kappos

David J. Kappos
*Director of the United States Patent and Trademark Office*